United States Patent [19]

Carty, Jr.

[11] Patent Number: 4,462,593

[45] Date of Patent: Jul. 31, 1984

[54] MARTIAL ARTS PRACTICE WEAPON CONSTRUCTION

[75] Inventor: Edwin J. Carty, Jr., Cranston, R.I.

[73] Assignee: Jukobudo, Inc., Providence, R.I.

[21] Appl. No.: 410,866

[22] Filed: Aug. 23, 1982

[51] Int. Cl.[3] ..... F41B 15/02

[52] U.S. Cl. ..... 273/84 R

[58] Field of Search ..... 273/84, 77 R, 67 R, 273/193 B; 272/124

[56] References Cited

U.S. PATENT DOCUMENTS 1,909,932 5/1933 Digel ..... 273/84 R 3,357,705 12/1967 Blanchard ..... 272/124 X

OTHER PUBLICATIONS

"Black Belt", Feb. 1978, p. 69.

*Primary Examiner*—George J. Marlo

*Attorney, Agent, or Firm*—Salter & Michaelson

[57] ABSTRACT

A practice weapon construction for use by persons engaged in the martial arts during practice or sparring sessions is disclosed. The weapon includes a lightweight central elongated padded bar element, a lightweight padded cap element and a resilient spring element or the like which resiliently secures the cap element to an end of the bar element. When the cap element of the weapon engages an opponent, it is resiliently movable relative to the bar element so that the weapon delivers only a glancing blow to the opponent to reduce the risk of personal injury.

5 Claims, 5 Drawing Figures

MARTIAL ARTS PRACTICE WEAPON CONSTRUCTION

BACKGROUND AND SUMMARY OF THE INVENTION

The instant invention relates to the martial arts and more particularly to a practice weapon for use during practice or sparring sessions by those engaged in the martial arts.

Interest in the martial arts has increased substantially over the last decade; and, as a result, the number of schools, organizations and associations involved in the advancement and development of skills in the martial arts has increased correspondingly. This increase in interest has extended to a variety of different disciplines of the martial arts on both competitive and noncompetitive levels. A variety of forms of the martial arts have also become increasingly significant in police training.

Although some forms of the martial arts do not involve the use of weaponry of any type, other forms involve the use of an array of ancient oriental weaponry. In this connection, the use of weaponry such as a staff (an elongated member by itself), a "tonfa" (an elongated member having a perpendicularly extending handle adjacent to an end thereof), or a "nunchaku" (a pair of elongated members interconnected by means of a chain or cord) is well known in some disciplines of the martial arts. In the traditional combat embodiments of these weapons, the elongated members thereof are generally made of a dense hard wood such as oak or maple to permit a user thereof to inflict a serious damaging blow upon an opponent.

The use of the traditional embodiments of weaponry of the above described types in practice or sparring sessions has proven to be impractical for obvious reasons. However, interest in the use of such weaponry still remains high for both private and police training. As a result, several types of training weapons have heretofore been developed and are currently available which are constructed of lightweight plastic or which include safety paddings on the exteriors thereof to prevent personal injury. However, even weapons embodying these safety features have proven to be capable of inflicting serious injuries upon persons struck by them.

Accordingly, it is seen that there is a significant need for a practice weapon construction which can be embodied in the above weapon configurations and which can be used by persons engaged in the martial arts without subjecting their opponents to serious physical risks. The instant invention provides a novel practice weapon construction which meets these criteria, and hence represents a significant advancement in the art of martial art weaponry. Specifically, the weapon construction of the instant invention comprises an elongated member which is defined by an elongated bar element having a padded casing thereon, a cap element having a padded casing thereon, and resilient means securing the cap element to the bar element in substantially axially aligned relation. Accordingly, when the cap element is impacted with an object or a person, the cap element is movable relative to the bar element so that the weapon is capable of delivering only a glancing blow to the person or object rather than a sharp damaging blow. The weapon construction of the instant invention can be embodied in a variety of configurations, including a staff comprising an elongated member which is defined by an elongated bar element having a padded casing thereon and a pair of cap elements which also have padded casings thereon and which are resiliently secured to opposite extremities of the bar element. It can also be embodied as a "tonfa" comprising an elongated member having a handle element which extends perpendicularly outwardly therefrom adjacent to an end thereof wherein the elongated member is defined by an elongated bar element having a padded casing thereon, a pair of cap elements having padded casings thereon and resilient means securing the cap elements to opposite extremities of the bar element. In addition, the weapon construction can be embodied as a "nunchaku" comprising a pair of elongated members which are interconnected by a cord or chain wherein each of the elongated members is defined by an elongated bar element having a padded casing thereon, a pair of cap elements which also have padded casings thereon and resilient means for securing the cap elements to opposite extremities of the respective bar elements so that they are resiliently movable relative thereto.

Due to the unique construction the weapon of the instant invention, the various embodiments thereof can be utilized by persons engaged in the martial arts who have various levels of proficiency without subjecting their sparring partners or opponents to substantial risks. Because the cap elements of the weapons are resiliently secured thereto, the cap elements are resiliently deflected when they are laterally impacted with an object or a person so that the weapon delivers only a glancing blow thereto. Further, when the weapon is longitudinally thrust against an opponent, the resilient spring adjacent to the end which engages the opponent absorbs the shock of the impact.

Accordingly, it is a primary object of the instant invention to provide a safe practice weapon construction for the martial arts.

Another object of the instant invention is to provide a safe weapon construction for the martial arts wherein a cap element of the weapon is resiliently deflectable relative to a bar element of the weapon so that when the cap element is impacted with an object or a person, it delivers only a glancing blow thereto.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
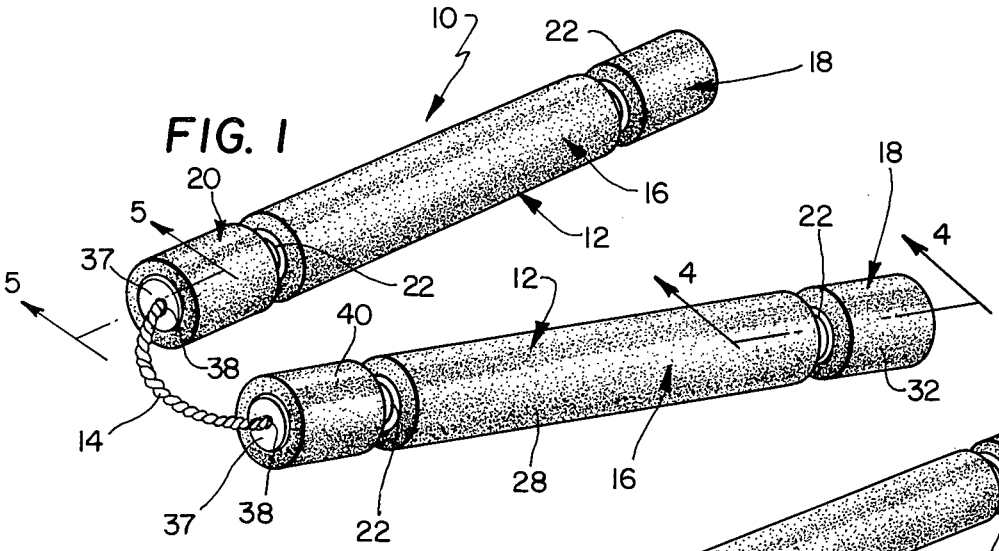
FIG. 1 is a perspective view of a first embodiment of the instant invention.

Referring now to the drawing, particularly FIG. 1, a first embodiment of the weapon construction of the instant invention is illustrated and is generally indicated at 10. The weapon 10 is a weapon of the type generally known as a "nunchaku" and comprises a pair of elongated members which are generally indicated at 12 and a section of cord 14 which interconnects an end of a first of the members 12 to an end of the second thereof. Accordingly, a user may use the weapon 10 by grasping one of the elongated members 12 and swinging the weapon 10 to cause the other of the members 12 to strike an opponent. However, due to the unique construction of the elongated members 12, as will hereinafter be set forth, the opponent receives only a glancing blow when so struck by the weapon 10 so that the risk of serious injury is minimized. Further, when one of the members 12 longitudinally engages an opponent, it delivers only a softened blow thereto.

The elongated members 12 each comprise a padded central bar element generally indicated at 16, a padded first cap element generally indicated at 18, a padded second cap element generally indicated at 20, and a pair of coil springs 22 which resiliently secure the cap elements 18 and 20 to opposite extremities of the bar element 16. In this connection, the springs 22 secure the cap elements 18 and 20 to the respective bar elements 16 so that they are resiliently deflectable and compressible relative thereto to provide resilient flexibility at the ends of the members 12. The bar elements 16 each comprise an inner tubular portion 24 which is preferably made of a comparatively lightweight rigid plastic material, such as a PVC plastic material, a pair of extension sleeves 26 which are received on opposite ends of the tubular portion 24 and a padded outer casing 28 which covers the tubular portion 24 and the extension sleeve 26 to provide a cushioned outer surface on the bar element 16. The cap elements 18 each comprise an inner tubular portion 30, a rigid inner cap 32 having a neck portion 34 which is received in the outer end of the respective tubular portion 30, and an outer padded casing 36 which is preferably made of a synthetic foam material and which covers the respective tubular portion 30 and the respective inner cap 32 to provide a cushioned outer surface on the respective cap element 18. The second cap elements 20 each comprise an inner tubular portion 30, an end element 37 having an axial aperture 38 therethrough and a neck portion 39 which extends into the respective tubular portion 30, and a padded outer casing 40 which covers the tubular portion 30 thereof but not the end element 37 thereof.

Figure 4:
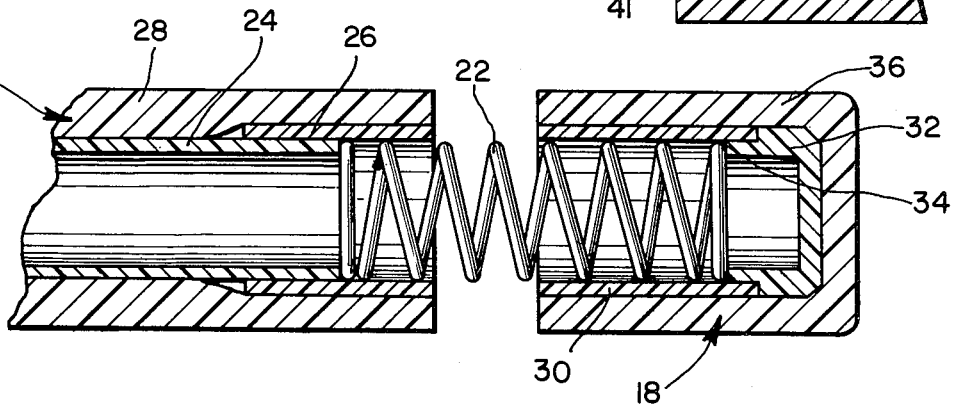
FIG. 4 is a fragmentary sectional view taken along line 4—4 in FIG. 1.

As above mentioned, the coil springs 22 resiliently secure the respective cap elements 18 and 20 to opposite extremities of the respective bar elements 16. The attachment of one of the cap elements 18 to its respective bar element 16 with a spring 22 is clearly illustrated in FIG. 4. As will be seen, each of the springs 22 is received in a respective extension sleeve 26 so that it abuts the adjacent terminal end of the respective tubular portion 24 of the bar element 16. The opposite end of each spring 22 is received in the respective tublar portion 30 so that it abuts the inner end of the neck portion 34 of the respective inner cap 32. The ends of each respective spring 22 are secured in the respective cap element 18 and extension sleeve 26 with a suitable adhesive such as an epoxy. The use of other suitable securing means such as protuberances or the like on the inner surfaces of the extension sleeves 26 and/or the tubular portions 30 which engage the springs 22 to thereby retain them in their desired positions, is also contemplated. Each of the cap elements 20 is also resiliently secured to its respective bar element 16 with a spring 22 in a manner similar to the cap elements 18. In this instance, however each respective spring 22 abuts the neck portion 39 in the respective cap 20. It should be brought out that in both instances the springs 22 are dimensioned to secure the cap elements 18 and 20 to the respective bar elements 16 while normally maintaining said elements in slightly axially spaced relation to permit resilient axial compression of the elongated members 12.

Figure 5:
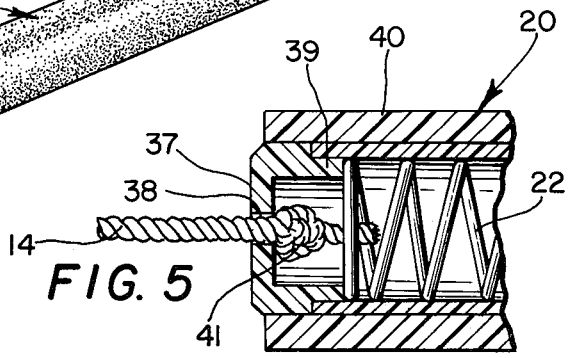
FIG. 5 is a fragmentary sectional view taken along line 5—5 in FIG. 1.

As further shown in FIG. 5, the cord 14 interconnects the cap elements 20 so that opposite ends of the cord 14 extend into the apertures 39. Enlarged knotted ends 41 which are of greater dimension than the apertures 39 retain the ends of the cord 14 in the cap elements 20, although it is understood that the use of other suitable securing means for this purpose is contemplated.

Accordingly, it is seen that the practice weapon 10 provides a safe embodiment of the heretofore known "nunchaku" type weapon which is particularly adapted for use in the martial arts for sparring or practice sessions. Specifically, it is seen that when one of the elongated members 12 is impacted with an object such as a person so that a lateral force is applied to an end of the member 12, the adjacent spring 22 absorbs most of the shock of the impact and permits the respective cap element 18 or 20 to be resiliently deflected relative to the bar element 16. Accordingly, only a glancing blow is delivered to the object or person by the member 12. Further, when one of the elongated members 12 is longitudinally impacted with an object or person so that an axial force is applied to said member 12, the springs 22 provide resilient compressibility to reduce the shock of the impact delivered to the person or object. The preferably lightweight construction of the members 12 and the padded casings 28, 36 and 40 thereof also contribute to a further reduction in the shock of such an impact.

Figure 2:
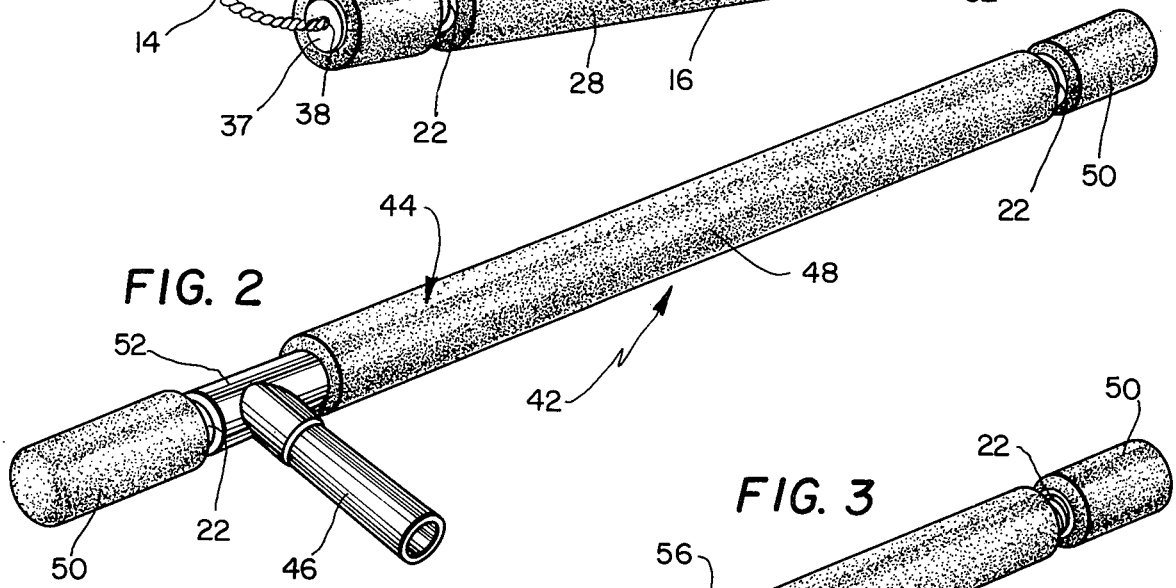
FIG. 2 is a perspective view of a second embodiment of the instant invention.

Referring now particularly to FIG. 2, an alternate embodiment of the practice weapon construction of the instant invention is illustrated and generally indicated at 42. The weapon 42 is a weapon of the type generally referred to as a "tonfa" and comprises an elongated member generally indicated at 44 having a handle element 46 which extends substantially perpendicularly outwardly therefrom adjacent to an end thereof. The member 44 comprises a padded central elongated bar element 48, a pair of padded cap elements 50 and a pair of springs 22 which secure the cap elements 50 to opposite extremities of the bar element 48 so that they are resiliently movable relative thereto. The bar element 48 is similar in configuration to the bar elements 16 although it is of slightly greater length and has a "T" shaped element 52 at one end thereof for securing the handle member 46 on the weapon 42. The cap elements 50 are similar in configuration to the cap elements 18 although they are of slightly greater length. The weapon 42 can also be safely used by persons engaged in practice or sparring sessions without substantial risk of inflicting serious injury upon an opponent. Specifically, the cap elements 50 are resiliently deflectable upon lateral engagement thereof with an opponent so that the opponent only receives a glancing blow. Further, when the weapon 42 is longitudinally advanced into impacting engagement with an opponent, the adjacent spring 22 absorbs most of the shock of the blow to minimize the hazards associated therewith.

Figure 3:
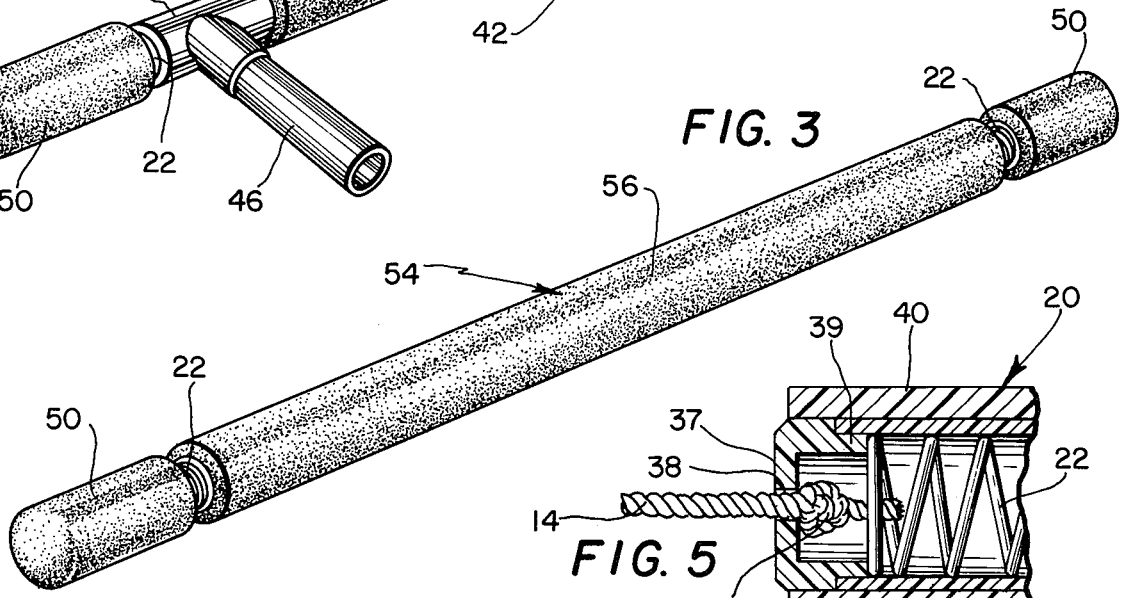
FIG. 3 is a perspective view of a third embodiment thereof.

The weapon illustrated in FIG. 3 and generally indicated at 54 is a still further embodiment of the weapon construction of the instant invention and is a weapon of the type commonly known as a staff. The weapon 54 comprises an elongated member which is defined by a central elongated bar element 56, a pair of cap elements 50 and a pair of the springs 22 which resiliently secure the cap elements 50 to the bar element 56 in substantially axially aligned relation. The bar element 56 is similar in configuration to the bar elements 16 although of greater length. The weapon 54 can also be safely used in practice or sparring sessions due to the resilient flexibility of the cap elements 50 relative to the bar element 56.

While the weapons 10, 42 and 54, as herein set forth, embody certain specific structure, it will be understood that various alternative embodiments of the weapon construction of the instant invention are contemplated. For example, the use of other types of resilient interconnecting means such as resilient rubberized elements and the like instead of the springs 22 is contemplated. In addition, alternative embodiments of the weapons 10, 42 and 54 are contemplated wherein padded casings are provided which cover over the springs 22 or other resilient means so that the respective elongated members are completely padded.

It is seen therefore that the weapon construction of the instant invention can be effectively embodied in a variety of configurations which are adapted for safe use in practice or sparring sessions by those engaged in the martial arts. The overall lightweight padded constructions of the weapons 10, 42 and 54 plus the resilient flexibility of the respective cap elements thereof relative to the respective bar elements thereof minimizes the risk of injury to sparring partners or opponents. For these reasons, the practice weapon construction of the instant invention represents a significant advancement in the art which has substantial commercial merit.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A practice weapon construction for the martial arts and the like, comprising an elongated bar element having a padded casing located thereon, a padded cap element positioned adjacent to said bar element at an end thereof, resilient means received within at least a portion of said bar element at said end thereof and engaging said cap element in substantially axially aligned relation, so that said cap element is resiliently movable relative thereto upon impact of said cap element with an object, and stop means secured within said elongated bar element adjacent to an end thereof and receiving the innermost end of said resilient means, said stop means defining an inner stop for fixing the inner end of said resilient means in said bar element, a substantial portion of said resilient means extending beyond the outermost end of said bar element and being disposed in a permanent position thereat, wherein impact exerted in a longitudinal direction against the outermost end of said cap element by contact with an opponent of the user of the weapon results in a biased inward movement of said cap element in a longitudinal direction thereof relative to said bar element, the resilient means thereby effectively absorbing the longitudinal impact on said cap element without injury to said opponent.

2. A practice weapon construction as claimed in claim 1, said cap element also being laterally deflectable relative to said bar element.

3. A practice weapon construction as claimed in claim 8, a second cap element being secured to the other end of said bar element by a second resilient means that extends therein and into the other end of said bar element, and a second stop means secured within said elongated bar element at the other end thereof and defining an inner stop for fixing the inner end of said second resilient means in said bar element.

4. A practice weapon construction as claimed in claim 3, a pair of said bar elements each having said cap element secured to opposite extremities thereof with said resilient means extending therein and into said bar elements, and an elongated flexible member interconnecting a cap element of one of said bar elements to a cap element of the other thereof to define a "nunchaku" type of practice weapon.

5. A practice weapon construction as claimed in claim 3, a handle member being attached to said elongated bar element in substantially perpendicular relation adjacent to an extremity thereof to define a "tonfa" type of practice weapon.

* * * * *